United States Patent [19]

Carter et al.

[11] Patent Number: 4,865,179

[45] Date of Patent: Sep. 12, 1989

[54] CONVEYOR SYSTEM FOR ROD-LIKE ARTICLES

[75] Inventors: David C. M. Carter, Milton Keynes; Kerry Hierons, Saunderton, both of England

[73] Assignee: Molins PLC, London, England

[21] Appl. No.: 183,087

[22] Filed: Apr. 19, 1988

Related U.S. Application Data

[63] Continuation of Ser. No. 721,438, Apr. 9, 1985, abandoned.

[30] Foreign Application Priority Data

Apr. 9, 1984 [GB] United Kingdom ..... 8409096
Aug. 30, 1984 [GB] United Kingdom ..... 8421940

[51] Int. Cl.[4] ..... B65G 1/00

[52] U.S. Cl. ..... 198/347; 198/358; 198/572; 53/493; 131/283

[58] Field of Search ..... 198/347, 358, 572, 573, 198/575, 577; 414/403, 404; 53/154, 493; 131/282, 283

[56] References Cited

U.S. PATENT DOCUMENTS

| | | | |
|---|---|---|---|
| 3,952,854 | 4/1976 | Selonke et al. | 198/347 |
| 3,992,182 | 11/1976 | Frank | 198/577 |
| 4,120,391 | 10/1978 | Molins et al. | 198/347 |
| 4,149,545 | 4/1979 | Hall | 198/347 |
| 4,200,181 | 4/1980 | Clarke | 198/347 |
| 4,280,611 | 7/1981 | Molins et al. | 198/347 |
| 4,339,026 | 7/1982 | Baese et al. | 198/347 |
| 4,359,152 | 11/1982 | Czoch et al. | 198/575 |
| 4,366,895 | 1/1983 | Bennett et al. | 198/347 |
| 4,507,040 | 3/1985 | Baese et al. | 198/347 |
| 4,690,604 | 9/1987 | Calverley et al. | 414/403 |

FOREIGN PATENT DOCUMENTS 2133759 8/1984 United Kingdom .

*Primary Examiner*—Joseph E. Valenza
*Attorney, Agent, or Firm*—Antonelli, Terry & Wands

[57] ABSTRACT

Cigarettes in multi-layer stack formation are delivered from a maker (10) to a packer (12) on a path having a first junction (24) connected to a tray filling unit (30) and a second junction connected to a tray unloading unit (38). Control circuitry (54–72) is provided to control transfer of cigarettes at the first junction (24) according to the relative speeds of the maker and packer and/or the capacity of a reservoir (46) associated with the path. The control circuitry (54–72) prevents too frequent operation of a gate (32) associated with the first junction (24) and allows operation of the tray filling unit (30) at an optimum speed.

29 Claims, 1 Drawing Sheet

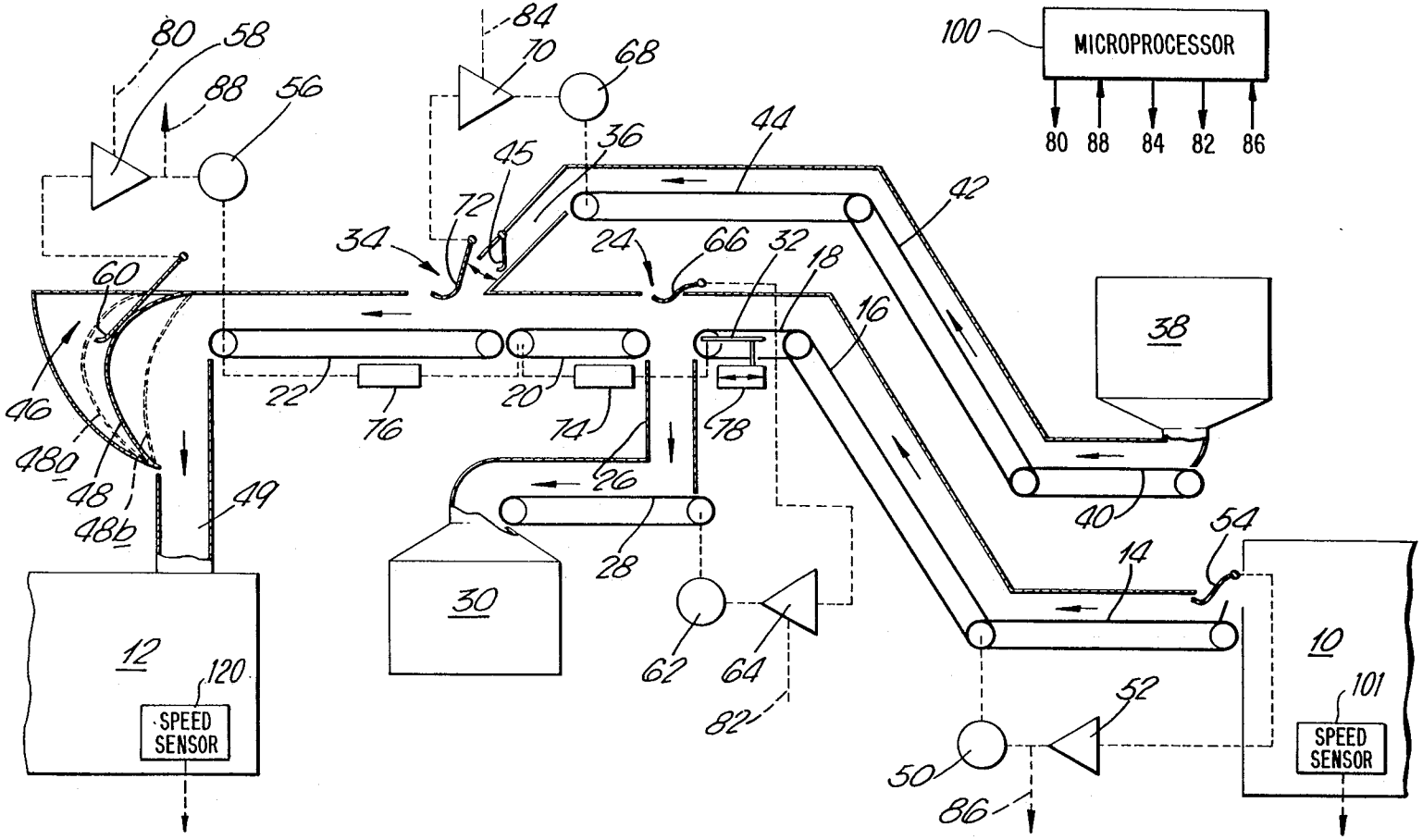
MICROPROCESSOR
SPEED SENSOR
SPEED SENSOR

CONVEYOR SYSTEM FOR ROD-LIKE ARTICLES

This is a continuation Ser. No. 721,438, filed Apr. 9, 1985 now abandoned.

This invention relates to conveying rod-like articles, particularly articles of the tobacco industry such as cigarettes or filter rods.

In the cigarette industry it is known to link a machine for producing rod-like articles, e.g. a cigarette making machine or filter rod making machine, to a tray filler or similar machine for placing the articles in containers. Subsequently the full containers are unloaded by a tray unloader or the like and delivered to a receiving machine, e.g. a cigarette packing machine or filter rod pneumatic distribution unit. It is also known to form rod-like articles into a substantially continuous stream for delivery from a producing machine to a receiving machine. It is further known to provide means for loading containers from such a stream and means for unloading the contents of containers for delivery to the stream. Examples of systems such as this are disclosed in British patent specification Nos. 1404142, 1557458, and 2142894. The present invention is particularly but not exclusively applicable to systems disclosed in said specification No. 2142894.

According to one aspect of the invention a conveyor system for rod-like articles includes a delivery device, a receiving device, conveyor means for conveying rod-like articles in multi-layer stack formation on a path between the delivery device and the receiving device, and a junction on said path for transferring articles between said path and a subsidiary path, including means for sensing a speed associated with the delivery device or an upstream part of the conveyor means, means for sensing a speed associated with the receiving device or a downstream part of the conveyor means, and means for controlling transfer of articles between said path and said subsidiary path, said controlling means having first and second operative conditions according to the difference between said speeds.

Preferably the controlling means includes means for inhibiting transfer of articles between said path and said subsidiary path if said speeds differ by less than a predetermined amount.

In this case preferably the conveyor system includes a variable capacity reservoir associated with said path, means for sensing the capacity of said reservoir, and means for overriding said inhibiting means to allow transfer between said path and said subsidiary path when said capacity sensing means indicates that the capacity of said reservoir has attained a first critical value. Preferably said inhibiting means is reinstated when said sensing means indicates that the capacity of the reservoir has attained a second critical value.

In a preferred arrangement the junction and subsidiary path are connected to a device for storing rod-like articles, e.g. a tray filler, and when the delivery device has a speed which exceeds the receiving device by a relatively small amount (e.g. less than 10%) the inhibiting means prevents transfer to the subsidiary path until a reservoir associated with the main path has filled to a first critical value. The inhibiting means is then overriden and articles are transferred to the storing device. If the quantity of articles in the reservoir falls to a second critical value the inhibiting means is reinstated and the cycle repeats if the speeds of the delivery device and receiving device continue to differ by less than said predetermined amount. Preferably if the speeds differ by more than said predetermined amount the inhibiting means is overriden irrespective of the capacity of the reservoir.

The subsidiary path may lead to a storage device in the form of a reversible reservoir for rod-like articles in multi-layer stack formation, such as Molins OSCAR. The controlling means could include control means for reversibly operating the reservoir.

The controlling means may comprise inhibiting means which stops or prevents operation of conveyor means associated with said subsidiary path, and/or it may comprise physical blocking means in the form of a closure device for blocking the subsidiary path at or adjacent the junction. For example, a rolling band closure of the type disclosed in British patent specification No. 2066761 may be used or, alternatively, a closure of the type disclosed in U.S. application Ser. No. 721,414 filed April 9, 1985 may be used. The disclosure of said application is hereby incorporated herein in its entirety.

The invention is particularly usefully applied in a conveyor system incorporating a junction leading to a tray filling unit where, if the speed of the delivery device exceeds that of the receiving device by a relatively small amount, there would be a tendency for the articles to be passed to the subsidiary path frequently and/or at a slow rate. This is often undesirable, particularly where the articles are cigarettes, since it may lead to degradation of the articles. In particular, frequent operation of inhibiting means such as a closure device is preferably avoided.

By providing a reservoir which has a capacity beyond its normal operating level it is possible to ensure that under normal conditions successive transfer operations are separated by a predetermined time interval. The speed of movement of articles on the subsidiary path, e.g. to the tray filler, may be selected so that the time taken for the reservoir capacity to resume its normal value (i.e. the second critical value) from its maximum or high capacity (i.e. at its first critical value) is approximately equal to the time taken for the reservoir capacity to increase from its normal to its maximum level when transfer is prevented.

By way of explanation, the term "means for sensing a speed" as used herein is intended to include means which responds indirectly to speed. Thus, for example, means responsive to net flow rate, such as level sensors used conventionaly to control conveyance of cigarettes in multi-layer stack formation, are regarded as speed sensing means at least for the reason that they can respond to a change in speed. Similarly other sensors not directly measuring speed are included, as are sensors directly measuring the speed of a driven conveyor for example.

According to another aspect of the invention a conveyor system for rod-like articles includes a delivery device, a receiving device, conveyor means for conveying rod-like articles in multi-layer stack formation on a path between the delivery device and the receiving device, and a junction on said path for transferring articles between said path and a subsidiary path, means for conveying articles on said subsidiary path, means for sensing a speed associated with the delivery device or an upstream part of the conveyor means, means for sensing a speed associated with the receiving device or a downstream part of the conveyor means, and control means for controlling transfer of articles between said path and said subsidiary path, said control means including means for intermittently transferring articles at a rate which is not directly related to the difference between said speeds.

The control means may include means for transferring articles at a predetermined rate, preferably with predetermined minimum intervals between periods of operation. A variable capacity reservoir may be associated with said path, said control means being arranged so that articles are transferred to or from said reservoir respectively when articles are transferred from or to said subsidiary path. The control means may be arranged to adjust the flow of articles between said reservoir and said path to return the capacity of said reservoir to a predetermined level following transfer of articles between said path and said subsidiary path. The control means may be arranged to temporarily adjust the speed of the delivery device or the receiving device when articles are transferred between said path and said subsidiary path.

According to a further aspect of the invention a conveyor system for rod-like articles includes a delivery device, a receiving device, conveyor means for conveying rod-like articles in multi-layer stack formation along a path between the delivery device and the receiving device, at least one junction on said path at which articles may be transferred between a subsidiary path and said path, a variable capacity reservoir associated with said path at a location spaced from said junction, means for sensing the capacity of said reservoir, and means for controlling transfer of articles at said junction according to signals received from said sensing means. The controlling means may include means for inhibiting transfer at said junction when said reservoir contains less than a predetermined quantity of articles.

The junction may be connected to a device, e.g. a tray filler, for receiving articles from the path when the rate of operation of the delivery device exceeds that of the receiving device so that there is a net system excess. The arrangement may be used in this instance to inhibit continuous or frequent flow to or from the path at the junction. Such a junction may be provided with physical means for blocking a subsidiary path leading from the junction. Such means may take the form of a gate or other closure device projectable across said subsidiary path and forming a part of said inhibiting means. It may be undesirable to operate such a closure device frequently where the speeds of the delivery device and receiving device are relatively similar and it is not possible or it is undesirable to operate the tray filler or other device connected to the subsidiary path at a slow rate corresponding to the difference between said speeds.

Alternatively the junction may be connected to a device, e.g. a tray unloader, for delivering articles to the path when the rate of operation of the receiving device exceeds that of the delivery device. The inhibiting means may include a closure device at or adjacent said junction and/or control means for conveying articles along a subsidiary path leading to said junction.

The system may include first and second junctions and first and second subsidiary paths, first conveying means for conveying articles away from said first junction on said first subsidiary path, second conveying means for conveying articles towards said second junction on said second subsidiary path, said controlling means including means for selectively controlling operation of said first and second conveying means according to said signals. The controlling means may prevent simultaneous operation of the first and second conveyor means.

According to a further aspect of the invention a conveyor system for rod-like articles in multi-layer stack formation includes first and second junctions, first conveyor means upstream of said first junction, second conveyor means downstream of said second junction, and intermediate conveyor means between said first and second junctions, including means for connecting said first and intermediate conveyor means for common drive, and means for connecting said intermediate and second conveyor means for common drive. In a preferred arrangement a subsidiary path for receiving articles from the system extends from said first junction and a subsidiary path for supplying articles to the system extends to said second junction. Preferably said first and intermediate conveyor means are under common drive when articles are supplied to said system from said second junction, and said intermediate and second conveyor means are under common drive when articles are received from said system from said first junction.

The invention will be further described, by way of example only, with particular reference to the accompanying diagrammatic drawing, which shows a conveyor system for cigarettes.

The conveyor system extends between a cigarette making machine 10 and a cigarette packing machine 12, and includes endless band conveyors 14, 16, 18, 20, and 22, which convey cigarettes in stack formation on a path from the making machine to the packing machine.

A gap between the conveyors 18 and 20 defines a junction 24 from which a path 26 extends downwards to another endless band conveyor 28 which leads to a tray filling unit 30. A reversible gate 32 may be projected across the path 26 at the junction 24 to block passage of cigarettes on said path. The gate may be substantially as disclosed in U.S. specification No. 2066761, or in British patent application Ser. No. 721,414.

The conveyor system includes another junction 34, which is downstream of the junction 24 and at which an inclined path 36 meets the path defined by conveyors 20 and 22 just downstream of the end of conveyor 20. The path 36 receives cigarettes from a path leading from a tray unloader unit 38 and including endless band conveyors 40, 42, and 44. A pivoted gate 45 is arranged to close the path 36 when cigarettes are not conveyed from the tray unloader 38.

At the end of the conveyor 22, and above the packing machine 12, a variable capacity buffer reservoir 46 is provided. A flexible membrane 48 confines the cigarettes in the reservoir 46. A chute 49 leads to the packing machine 12 from the reservoir 46.

The tray filler 30 and tray unloader 38 may be substantially as described in British patent specification No. 2142894, and means may be provided for conveying trays between the filler and the unloader. The tray filler 30 and tray unloader 38 may be disposed substantially as shown in FIGS. 12–18 of said application: in this instance the filler and unloader are disposed at 90° to each other and the path 26 would preferably comprise a 90° twisted downdrop.

In the drawing lower band conveyors 14, 16 etc. only have been shown, for clarity. Upper endless band conveyors for controlling the upper surface of a stack on the lower conveyors are normally provided.

The conveyor bands 14, 16 and 18 are driven by a motor 50 which has a motor controller 52 which receives signals from a sensor 54 located at the position where the stack is formed or received on the conveyor 14 from the making machine 10. The conveyor band 22 is normally driven by a motor 56 having a motor controller 58 receiving signals from a sensor 60 resting on the membrane 48 of the reservoir 46. The conveyor 28 is controlled by a motor 62 having a motor controller 64 and receiving signals from a sensor 66 above the junction 24. The conveyor bands 40, 42, and 44 are driven by a motor 68 having a motor controller 70 and receiving signals from a sensor 72 above the junction 34. It will be understood that the tray filling unit 30 and tray unloading unit 38 are operated at speeds appropriate to the speeds of the conveyors 28 and 40 respectively. The conveyor 20 may be driven at the speed of the conveyors 14, 16, and 18 by engagement of a first clutch unit 74, or at the speed of the conveyor 22 by engagement of a second clutch unit 76. The gate 32 at the junction 34 is operated by a solenoid-controlled air cylinder 78.

The motor controllers 52, 58, 64, and 70, clutches 74, 76, and cylinder 78 are included as part of a circuit including a microprocessor 100 which imposes certain conditions of operation and performs other functions to control operation of the system. Each of the motor controllers 58, 64, and 70 is controlled by the microprocessor 100 in such manner that enable signals must be provided respectively on lines 80, 82, and 84 to allow operation of the respective motor. The enable signals on lines 82 and 84 are normally mutually exclusive, so that the tray filling unit 30 and the tray unloading unit 38 cannot operate together.

In operation, cigarettes are conveyed from the maker 10 to the packer 12 by way of conveyors 14, 16, 18, 20, and 22. Conveyor 22 is driven at such speed by motor 56 under control of sensor 60 that the sensor remains at or returns to a mean or normal position (indicated by the full line position of membrane 48). Similarly, the conveyor 14 is driven by the motor 50 at a speed dictated by the position of sensor 54. Rate signals are taken from the controllers 52 and 58, on lines 86, 88, respectively, as indications of the current speeds of the making machine 10 and packing machine 12, and are fed to the microprocessor 100. Alternatively, or additionally, such signals may be taken directly from a speed sensor 101 at the making machine 10 and/or a speed sensor 121 at the packing machine 12.

If the rate signal from the controller 52 or the making machine 10 (hereinafter referred to simply as maker speed) is the same as the rate signal from the controller 58 or the packing machine 12 (hereinafter referred to as packer speed) then the system is balanced and the following conditions apply. The gate 32 extends across the junction 24 closing the path 26, clutch 74 is activated and clutch 76 is deactivated, so that conveyor 20 moves at the same speed as conveyors 14, 16, and 18. Since the system is in a balanced condition the speed of conveyor 22 will be substantially the same as that of conveyors 14, 16, 18, and 20.

If the maker speed is less than the packer speed the same conditions apply as when the system is in balance, except that an enable signal is present on line 84. The motor controller 70 receives a signal directly from the microprocessor 100 to drive the motor 68 at a speed appropriate to the difference between the maker and packer speeds. Signals from the sensor 72 provide fine control of this speed if necessary. Cigarettes unloaded from a tray at the tray unloading unit 38 are delivered onto the conveyor 22 underneath the sensor 72. The pivoted gate 45, which is lightly biased into the closed position (e.g. by a spring or counterbalance weight), is merely pushed aside by the cigarettes advanced by the conveyor 44. When there is no longer a requirement for cigarettes from the tray unloader 38 and the conveyor 44 consequently stops, the bias pressure on gate 45 is sufficient to progressively and gradually close the path 36 and retain the upstream cigarettes against gravity. The closing action of the gate 45 is relatively gentle and allows cigarettes to trickle past the gate for a short while after the conveyor 44 has stopped.

When the maker speed is greater than the packer speed the microprocessor 100 controls the system differently depending on whether the maker speed exceeds the packer speed by more or less than a threshold value (e.g. 5–10%). The threshold value may be selected to reduce unnecessary operation of the tray filling unit, and hence of the gate 32, when the net system excess is such that the reservoir 46 can absorb the excess for a reasonable time (e.g. at least 20 seconds) before reaching its maximum capacity.

If the maker speed exceeds the packer speed by more than the threshold value then there is a net system excess which is considered sufficient to require normal operation of the tray filling unit 30. Hence the gate 32 is opened, an enable signal is present on line 82, clutch 76 is activated and clutch 74 deactivated so that conveyors 20 and 22 are driven at the same speed, and motor 62 is driven at a speed appropriate to the difference between the maker speed and packer speed (e.g. by signal direct from the microprocessor 100 to the controller 64 along line 82). Signals from the sensor 66 at junction 24 provide fine control of this speed if necessary.

If the maker speed exceeds the packer speed by less than the threshold value then the enable signal on line 80 is removed (so that the motor 56 no longer operates to drive conveyor 22) and both clutches 74 and 76 are activated so that conveyors 14, 16, 18, 20, and 22 operate at the same speed. The gate 32 may be in its open or closed position depending on previous conditions of the system: it will be assumed that the gate is in its closed position. Since the maker speed exceeds the packer speed the excess will progressively fill the reservoir 46. When the sensor 60 indicates that the membrane 48 has reached the position 48*a*, in which the reservoir 46 has reached its normal maximum capacity the gate 32 is opened and the clutch 74 deactivated. The conveyor 28 is then driven at a speed selected such that the membrane 48 of reservoir 46 returns to its normal position (indicated by the full line) in about 20–30 seconds (or other preselected period) when maker speed is at the system maximum. When the sensor 60 indicates that the membrane 48 has reached its normal level the gate 32 is closed and clutch 74 once again activated so that the system conveyors 14–22 once again move at the same speed. The cycle will then repeat if the maker speed remains greater than the packer speed by less than the threshold value.

An example of how the speed of conveyor 28 may be selected follows. Assume that the maker speed is 10,000 c.p.m. (cigarettes per minute), that the threshold value is 10% so that the minimum packer speed for operation in the intermittent tray filler mode is 9,000 c.p.m., that the minimum time required between operations of gate 32 is 30 seconds, and that the capacity of reservoir 46 between normal and maximum positions of the membrane 48 is 500 cigarettes. Then the net excess or deficiency in the system which is to be provided or absorbed by the reservoir 46 (dependent on whether the tray filler 30 is or is not operating) is 500 cigarettes in 30 seconds, i.e. a rate of 1,000 c.p.m.

Then:

$M-F+R=P$ where M is the maker speed, F is the tray filler speed (i.e. speed of conveyor 28), R is the rate of supply of cigarettes from the reservoir 46, and P is the packer speed.

Therefore $F=M-P+R$ so that in the example above

F=2,000 c.p.m.

The requirement for a maximum frequency of operation of the gate 32 is to avoid possible cigarette degradation caused by too frequent operation of the gate.

The following points should be noted concerning operation of the system. The gate 32 is closed at all times other than when the tray filling unit 30 is in operation: this avoids potential degradation of cigarettes across the downdrop of path 26. The system allows operation of the tray filler 30 and its associated gate 32 to be reduced by providing a buffer capacity in reservoir 46. A buffer reservoir could theoretically be provided in the region of junction 24 but space is limited here and cigarettes would be likely to be subjected to more pressure than in the reservoir 46, which is located in a position of low cigarette pressure. Hysteresis is built into the motor controllers to avoid unnecessary reversals and fluctuations under exact balanced conditions, and to smooth sensor fluctuations. It is possible that the sensors 66 and 72 could simply operate on an on-off principle: the sensors 54 and 60 preferably operate proportionately.

The reservoir 46 performs the additional function of buffering tray changes in the tray unloader unit 38. In the normal position of the membrane 48 the reservoir 46 has sufficient capacity above its minimum capacity (indicated by the dotted line **48*b*) to supply the packing machine during the short period while a tray is being changed at the tray unloader unit 38. Subsequently the sensors 60 and 72 increase the respective speeds of motors 56 and 68 to ensure that the reservoir 46 has sufficient capacity before the next tray change is required. No such buffering is required for tray changes in the tray filling unit 30** since the unit includes its own buffer reservoir (not shown).

It will be appreciated that 2,000 c.p.m. (which is the speed of the tray filler in the example given above) is a relatively slow speed of operation for a modern tray filling unit. Where possibly more frequent operation of the gate 32 is acceptable the system may be operated under conditions which may be more favourable for the tray filler as follows.

A relatively high optimimum or minimum speed of operation of the tray filler is selected: this may be the normal maximum speed of the tray filler but could be less (e.g. in the range 3,000 c.p.m.-10,000 c.p.m.). Whenever maker speed exceeds packer speed by less than the threshold value and the membrane 48 of reservoir 46 reaches the normal maximum position **48*a* the tray filler 30 is brought into operation at its predetermined (optimium or maximum) speed, which is unrelated to the difference in speeds between the maker and packer. The tray filler 30 continues to operate until the membrane 48** regains the normal position: this will happen relatively more quickly with a higher speed of operation of the tray filler. This will be repeated as long as the maker speed exceeds the packer speed by less than the threshold value.

If the maker speed exceeds the packer speed by greater than the threshold value the tray filler 30 may be operated according to the difference in speeds as before. In this case the threshold value may be somewhat higher than the 5-10% previously mentioned, e.g. 20% or more, so that the required speed of the tray filler is not too low. Preferably, however, when the maker speed exceeds the packer speed by more than the threshold value the tray filler continues to be operated, when required, at the predetermined speed. If this speed is less than the maximum speed of the tray filler the speed of the tray filler may be increased (by a signal on line 82) if the difference in speeds between the maker and packer exceeds the predetermined speed. If the predetermined speed of the tray filler is greater than the maximum speed of the maker the tray filler may be operated at that speed whenever its operation is required (irrespective of the difference in speeds between the maker and packer and irrespective of whether that difference is greater than or less than any threshold value).

When the tray filler is operated at a speed unrelated to the difference between maker and packer speed it operates intermittently for periods which depend on that difference and also on the capacity of the reservoir 46 between the positions 48 and **48*a* of the membrane. If it is required to reduce frequency of operation of the gate 32 yet retain a high tray filler operating speed that capacity of the reservoir 46** may be increased.

Alternatively, or additionally, the system may be operated so that when the tray filler is required to be operated the speed of the packer may be reduced to allow the tray filler to be operated at its optimium speed, i.e. at a speed which is greater than the difference between the maker speed and the normal packer speed. The packer speed may be reduced to a value which is equal to the difference between the speed of the maker and that of the tray filler. Alternatively the packer speed may be somewhat higher than this if the packer reservoir 46 can supplement the feed to the packer. Thus the packer could be run at any speed between maker speed and maker speed reduced by the speed of the tray filler. Where the speed of the packer is not the same as maker speed reduced by the speed of the tray filler the supply to the packer is supplemented by flow from the reservoir 46. If the reservoir 46 has insufficient capacity to continue supplying cigarettes to the packer while the tray filler is operating the speed of the packer will be reduced when the reservoir level reaches a low limit (e.g. the "normal" position of membrane 48).

It may be arranged that at times other than when the tray filler is in operation the packer speed is similarly temporarily reduced so that the reservoir 46 is filled to allow it to assume sufficient capacity to supplement the supply to the packer when next again operation of the tray filler is required.

It will be understood that control of the speed of the packer is undertaken by the microprocessor 100 and that such speed is subject to modification by a signal passed on line 88.

We claim:

1. A conveyor system for rod-like articles, including a delivery device, a receiving device, conveyor means for conveying rod-like articles in multi-layer stack formation on a path between the delivery device and the receiving device, and a junction on said path for transferring articles between said path and a subsidiary path, including means for sensing the speed of the delivery device, means for sensing the speed of the receiving device, means for controlling transfer of articles between said path and said subsidiary path, said controlling means including circuit means connected to receive signals which are proportional to speed from said respective sensing means and for detecting the difference in said speeds on the basis of said signals, means for comparing the difference between said speeds with a predetermined value, means for generating first and second control signals associated with first and second operative conditions according to the relation of said predetermined value to the difference between said speeds and means for inhibiting transfer if the detected difference in said speeds differs by less than a predetermined amount from said predetermined value, a variable capacity reservoir associated with said path, means for sensing the capacity of said reservoir, and means for overriding said inhibiting means to allow transfer between said path and said subsidiary path when said capacity sensing means indicates that the capacity of said reservoir has attained a first critical value.

2. A conveyor system as claimed in claim 1, including subsidiary conveyor means associated with said subsidiary path, wherein said inhibiting means includes means for controlling said subsidiary conveyor means.

3. A conveyor system as claimed in claim 1, wherein said inhibiting means includes physical blocking means at or adjacent said junction.

4. A conveyor system as claimed in claim 1, including means for reinstating said inhibiting means when said capacity sensing means indicates that the capacity of the reservoir has attained a second critical value.

5. A conveyor system as claimed in claim 1, wherein said subsidiary path is or connects said path to a store device for rod-like articles.

6. A conveyor system as claimed in claim 5, wherein said store device includes apparatus for loading articles into successive containers.

7. A conveyor system as claimed in claim 5, wherein said store device includes a variable capacity reservoir for rod-like articles in multilayer stack formation.

8. A conveyor system as claimed in claim 5, including a variable capacity reservoir associated with said path, said controlling means having at least two different operative conditions according to the capacity of said reservoir.

9. A conveyor system as claimed in claim 8, wherein said controlling means has a first operative condition in which transfer at said junction is initiated when the capacity of said reservoir has attained a critical value, said speed difference being less than a predetermined amount, and a second operative condition in which transfer at said junction is initiated when said speed difference exceeds said predetermined amount.

10. A conveyor system as claimed in claim 1, wherein said controlling means is arranged to cause transfer of articles at said junction when said speed difference exceeds a predetermined amount.

11. A conveyor system for rod-like articles, including a delivery device, a receiving device, conveyor means for conveying rod-like articles in multi-layer stack formation on a path between the delivery device and the receiving device, and a junction on said path for transferring articles between said path and a subsidiary path, means for conveying articles on said subsidiary path, means for sensing a speed associated with the operation of said delivery device, means for sensing a speed associated with the receiving device, a variable capacity reservoir associated with said path, means for sensing the capacity of said variable capacity reservoir, and control means for controlling transfer of articles between said path and said subsidiary path and between said path and said reservoir, said control means including first means for determining the difference between the speeds sensed by said respective speed sensing means, second means for comparing said difference with a predetermined range of differences, third means for intermittently transferring articles between said path and said subsidiary path at a rate which is not directly related to the difference between said sensed speeds, means for simultaneously transferring articles between said path and said reservoir in such a way as to compensate for the difference between said rate and said difference between said sensed speeds, fifth means for adjusting the flow of articles between said reservoir and said path to return the capacity of said reservoir to a predetermined level following transfer of articles between said path and said subsidiary path, sixth means for operating said third means and said fifth means alternately in sequence in accordance with the result of said comparison, and seventh means for alternately operating said fourth means and said fifth means in accordance with signals from said capacity sensing means.

12. A conveyor system as claimed in claim 11, wherein the control means includes means for transferring articles between said path and said subsidiary path at a predetermined rate.

13. A conveyor system as claimed in claim 11, wherein the control means includes means for transferring articles with predetermined minimum intervals between periods of operation.

14. A conveyor system as claimed in claim 11, wherein the control means includes conveyor means for articles on said subsidiary path.

15. A conveyor system as claimed in claim 11, wherein the control means includes physical blocking means at or adjacent said junction.

16. A conveyor system for rod-like articles, including an article producing machine, an article processing machine, conveyor means for conveying rod-like articles in multi-layer stack formation on a path between the article producing machine and the article processing machine, and a junction on said path for transferring articles between said path and a subsidiary path, means for conveying articles on said subsidiary path, means for sensing a speed of the article producing machine, means for sensing a speed of the article processing machine, means for determining the difference between the speeds sensed by said respective speed sensing means, and control means for controlling transfer of articles between said path and said subsidiary path, said control means including means for intermittently transferring articles at a rate which is not directly related to the difference between said speeds and means for temporarily adjusting the speed of the article producing machine or the article processing machine when articles are transferred between said path and said subsidary path to compensate for a difference between said rate and said difference between said speeds.

17. A conveyor system for rod-like articles, including a delivery device, a receiving device, conveyor means for conveying rod-like articles in multi-layer stack formation along a path between the delivery device and the receiving device, first and second junctions on said path at which articles may be transferred between first and second subsidiary paths and said path, respectively, a variable capacity reservoir associated with said path at a location spaced from said junctions, first means for sensing the capacity of said reservoir, second means for sensing articles at each of said junctions, first conveying means for conveying articles away from said first junction on said first subsidiary path, second conveying means for conveying articles towards said second junction on said second subsidiary path, and central control means connected directly to said first and second sensing means for controlling transfer of articles at said junctions by selectively controlling operation of said first and second conveying means according to signals received from said first and second sensing means to effect overall system control.

18. A conveyor system as claimed in claim 17, wherein the controlling means includes means for inhibiting transfer at said junction when said reservoir contains less than a predetermined quantity of articles.

19. A conveyor system as claimed in claim 17 wherein said controlling means includes means for selectively controlling operation of said first and second conveying means to control transfer of articles at said junctions in such a way as to prevent simultaneous operation of said first and second conveying means.

20. A conveyor system as claimed in claim 19, wherein said first and second conveying means respectively include means for delivering articles into successive containers and means for receiving articles from successive containers.

21. A conveyor system as claimed in claim 19, wherein said first junction is upstream of said second junction.

22. A conveyor system as claimed in claim 17, wherein said variable capacity reservoir is located such that transfer of articles to or from said path occurs at a location downstream of said first and second junctions.

23. A conveyor system as claimed in claim 17, wherein said variable capacity reservoir has first and second states of fill at which first and second signals are produced by said sensing means, said controlling means being arranged to respond to said first signal to initiate a transfer operation and to respond to said second signal to stop a transfer operation.

24. A conveyor system as claimed in claim 17, wherein said controlling means is arranged to transfer articles between said path and said subsidiary path at a predetermined minimum rate.

25. A conveyor system as claimed in claim 1, wherein said circuit means includes a microprocessor connected to receive signals from said respective sensing means.

26. A conveyor system as claimed in claim 17, wherein said central control means comprises means for preventing simultaneous operation of said first and second conveying means.

27. A conveyor system for rod-like articles, including an article producing machine, an article processing machine, conveyor means for conveying rod-like articles in multi-layer stack formation on a path between the article producing machine and the article processing machine, a junction on said path for transferring articles between said path and a subsidiary path, means for sensing a speed of the article producing machine, means for sensing a speed of the article processing machine, means for determining the difference between the speeds sensed by the respective speed sensing means, and control means for controlling transfer of articles at said junction, said control means including means for controlling passage of articles on said path and means for adjusting the speed of at least one of the article producing machine and the article processing machine to reduce the difference in speed between said producing machine and said processing machine when there is no transfer of articles between said path and said subsidiary path.

28. A conveyor system as claimed in claim 27, including a variable capacity reservoir associated with said path, and means for sensing the capacity of said reservoir, said control means being connected to receive signals from said capacity sensing means.

29. A conveyor system for rod-like articles, including an article producing machine, an article processing machine, conveyor means for conveying rod-like articles in multilayer stack formation on a path between the article producing machine and the article processing machine, a variable capacity reservoir connected with said path, means for sensing the capacity of said reservoir, means for sensing a speed of the article producing machine, means for sensing a speed of the article processing machine, means for determining the difference between the speeds sensed by the respective speed sensing means, and control means connected to said capacity sensing means and said respective speed sensing means for controlling passage of articles on said path, said control means including means for directly adjusting the speed of the article producing machine or the article processing machine in response to said means for sensing the capacity of the reservoir and the difference between the speeds of said article producing machine and said article processing machine.

* * * * *